United States Patent [19]

Kujas

[11] Patent Number: 4,732,804

[45] Date of Patent: Mar. 22, 1988

[54] ABLATIVE AND FLAME RESISTANT COMPOSITION

[75] Inventor: Erich F. Kujas, Philadelphia, Pa.

[73] Assignee: RCA Corporation, Princeton, N.J.

[21] Appl. No.: 775,363

[22] Filed: Sep. 12, 1985

[51] Int. Cl.[4] ..... D06M 7/00; D06M 11/02; B32B 27/02; B32B 27/16

[52] U.S. Cl. ..... 428/229; 428/265; 428/409; 428/920; 428/921

[58] Field of Search ..... 428/229, 265, 409, 920, 428/921

[56] References Cited

U.S. PATENT DOCUMENTS

| | | | |
|---|---|---|---|
| 3,650,102 | 3/1972 | Economy et al. | 428/229 |
| 3,723,588 | 3/1973 | Economy et al. | 264/83 |
| 4,064,359 | 12/1977 | Peterson et al. | 428/920 |
| 4,246,313 | 1/1981 | Stengle, Jr. | 428/920 |
| 4,463,465 | 8/1984 | Parker et al. | 428/920 |
| 4,473,614 | 9/1984 | Hockmeyer | 428/920 |

OTHER PUBLICATIONS

Gruntfest, Kirk-Othmer: Encyclopedia of Chemical Technology, vol. 1, pp. 11-21, "Ablation", (no date).

Kirk-Othmer: Encyclopedia of Chemical Technology, vol. 16, (1981), pp. 125-137, "Novoloid Fibers".

Encyclopedia of Polymer Science and Technology, vol. 15, (1971), pp. 370-373, "Phenolic Fibers".

Japanese Industrial Standard L 1091, "Testing Methods for Flammability of Cloths," Japanese Standards Association, Japan.

*Primary Examiner*—William J. Van Balen

*Attorney, Agent, or Firm*—Clement A. Berard, Jr.; Raymond E. Smiley

[57] ABSTRACT

A novel material is disclosed which is the reaction product of acrylic acid and a novoloid fiber. The material has excellent ablative and flame resistant properties.

9 Claims, No Drawings

ABLATIVE AND FLAME RESISTANT COMPOSITION

This invention relates to a novel ablative and flame resistant fibrous composition and to the method for the manufacture thereof.

BACKGROUND OF THE INVENTION

Ablation as used hereinafter refers to the dissipation of heat from an object generally by use of a material which is sacrificially eroded or ablated. Ablation is extremely important in the aerospace industry in that spacecraft, such as reuseable launch rockets and space shuttles, are subjected to extremely high temperatures as a result of heat generated by atmospheric friction on reentry into the earth's atmosphere. The heat which is generated, if not removed from the spacecraft, can destroy the entire spacecraft and/or the heat sensitive components of the spacecraft. In order to insure the survival of the spacecraft and the heat sensitive components on reentry, it has become standard practice in the aerospace industry to cover critical surface areas, such as the nose cone and leading edges of the spacecraft, with materials that ideally should erode or ablate slowly and smoothly in such a manner as to protect the spacecraft from the generated heat of reentry. In addition to the problems encountered as a result of the heat generated on reentry, problems concerning ablation are also of considerable interest to the aerospace industry in other areas, such as the protection of rocket nozzle structures from attrition by hot propellant gases and the insulation of rocket motor case structures from the heat of burning propellant. A more detailed description of ablation and the problems encountered as a result of ablation are discussed in Kirk-Othmer *Encyclopedia of Chemical Technology*, Vol. 1, pp. 11–21, which is incorporated by reference herein.

Numerous materials have heretofore been suggested for use as ablative materials but none have proven to be entirely suitable. The materials heretofore suggested have included organic, inorganic and composite materials. A class of materials which has been widely used and is generally considered to be the most suitable is the phenolic resins. The phenolic resins have certain properties which make them especially useful as ablative materials, such as forming a coke-like char and releasing low-molecular-weight gases on ablating which results in more effective dissipation of heat. Phenolic resins which have heretofore been used, however, did not by themselves have sufficient physical strength for use in many ablative applications and required reinforcement with substantial amounts of strong fibrous materials, such as asbestos, glass or nylon fibers. Other organic materials have also been employed to some extent as ablative materials such as the polyterephthalate fibers. Inorganic materials which were suggested have included graphite which has good ablative properties but has limited physical strength so that it cannot be used in many applications. Refractory ablative materials have also been suggested and likewise were found to be generally unsuitable for most applications because of the lack of resistance to thermal shock.

Another area of concern which is closely related to the problem of ablation is the provision of fabrics and the like which have decreased flammability. This is a particularly pressing problem in recent years because of the elimination of the use of asbestos in fabrics.

What whould be highly desirable would be a material which would have sufficient ablative properties so as to effectively dissipate heat in aerospace applications and which would not have the shortcomings, particularly low strength, of prior art materials. It would likewise be especially desirable if the material would exhibit low flammability so as to be usable in other applications such as protective clothing and the like.

SUMMARY OF THE INVENTION

It has been found that the fibrous reaction product obtained by reacting acrylic acid with a novoloid fiber has the ideal combination of properties for use as an ablative material and also has excellent flame resistance.

DETAILED DESCRIPTION OF THE INVENTION

Novoloid fibers are cross-linked phenolicaldehyde fibers. The generic term novoloid was recognized by the United States Federal Trade Commission as designating a manufactured fiber containing at least 85% by weight of a cross-linked novolac. Novoloid fibers are typically produced by first melt-spinning a novolac resin. The novolac resins which are employed are manufactured from phenols and aldehydes using an acid catalyst and excess of the phenol. The preferred novolac resin for fiber production is made from phenol and formaldehyde. The novolac resin is melt-spun to produce an extremely friable, whitish fiber. The melt-spun fibers are then cured by immersing the fibers in an acidic solution of formaldehyde followed by gradual heating to produce an acid-catalyzed cross-linking action. The extent of the cross-linking action is limited by steric factors as a result of which methylol groups are formed on the sites wherein the cross-links are not completed. The amount of methylol groups which are formed generally will constitute about 5–6% by weight of the cured fiber. The methylol groups which are formed have been found to be readily available for further reaction as will be pointed out in greater detail below.

The novoloid fibers are described in greater detail in Kirk-Othmer *Encyclopedia of Chemical Technology*, Vol. 16, pp. 125–137 which is incorporated by reference herein. Novoloid fibers are commercially sold under the trademark Kynol and are available from various sources including Nipon Kynol, Inc. (Japan) and American Kynol, Inc.

The novoloid fibers have excellent textile properties, such as being flexible and having relatively high strength and the like, and as such can readily be fabricated into non-woven, knitted and woven fabrics. The fabrics made from the novoloid fibers have been found to have relatively high flame resistance. Moreover, when exposed to flame, the novoloid fabrics do not melt but rather gradually char until completely carbonized. The novoloid fabrics being made from phenolic resins, a class of materials heretofore recognized as being relatively satisfactory for ablative applications and having the desirable properties of charring rather than melting, would appear to be a suitable material for ablative applications. However, it was determined after suitable testing that the fabrics made from the nóvoloid fibers were not satisfactory for ablative application as the fabrics during testing were found to exhibit excessive smoldering times and carbonization rates.

It is known from literature that novoloid fabrics are subject to oxidation degradation similar to phenolic resins in general. The oxidation degradation appears to involve mainly oxidation of the methylene linkage between the aromatic units leading to degradation of the phenolic resin. It was further reported that the oxidation degradation reaction could be prevented by reacting the novoloid fibers with acetic anhydride to form an acetylated novoloid fiber. Because of the lower oxidation degradation properties, the acetylated novoloid fibers formed into a fabric were evaluated as ablative materials. Surprisingly, the acetylated novoloid fabrics were found to be even less suitable than the untreated novoloid fabrics for ablative applications in that the physical strength of the fabric was significantly reduced and, even more importantly, the after-flame, smoldering time and carbonization rates were significantly increased as compared to untreated novoloid fabrics.

It was then found in accordance with the teachings of this invention that novoloid fibers can be chemically modified so as to have substantially improved properties of the type required for ablative applications by reacting the novoloid fiber with acrylic acid ($CH_2{=}CH_2{-}COOH$). The exact chemical reaction of the acrylic acid with the novoloid fiber is not known for certain and is not relied on for purposes of patentability. It is believed, however, that the acrylic acid reacts with the methylol groups of the novoloid fiber and thereafter secondary reactions occur wherein there is cross-linking between the double bonds of the acrylic acid groups within the novoloid fiber. In the treatment of the novoloid fiber with acrylic acid in accordance with this invention, excellent results have been obtained with the commercially available novoloid fiber which contains between 5–6% by weight of methylol groups. The exact lower amount of the acrylic acid reacted with the novoloid fiber is not critical as even realtively small amounts of acrylic acid have been found to have a beneficial effect on the ablative properties of novoloid fibers. It has been determined, however, that optimum results are obtained when the acrylic acid is reacted with the novoloid fiber in a ratio equal to about 2–4 moles of acrylic acid per methylol group of the novoloid fiber. The desirable properties of increased tensile strength, increased tear strength, absence of after-flame, elimination of smoldering time, and a minimal amount of carbonization is obtained with the above-noted ratio of moles of acrylic acid to methylol groups of the novoloid fiber, and particularly when the commercially available novoloid fiber having the 5–6% methylol groups is treated.

The treatment process employed in the practice of the present invention can be conducted on the novoloid fiber prior to formation into a fabric. It is preferable, however, to initially convert the novoloid fibers into a fabric and then treat the fabric with acrylic acid. In the treatment process, acrylic acid, in either a concentrated form or diluted with a suitable solvent, is impregnated into the novoloid fiber or fabric. The treated fiber or fabric is then held under tension while being heated to a temperature of about 235° C. for about two minutes. When treating novoloid fabrics with the acrylic acid, it is preferable to maintain a slight tension on the fabric during treatment with, for example, a tenter frame. During the treatment process with the acrylic acid, any excess unreacted acrylic acid will vaporize and be removed from the final product.

An evaluation was made of various materials to determine their properties relative to the acrylic acid-treated novoloid fabric of the present invention. For purposes of comparison, fabrics of identical structures were prepared from untreated novoloid fibers, acetylated novoloid fibers, acrylic acid treated fibers of this invention prepared from commercially available novoloid fibers containing 5–6% by weight of methylol groups reacted with four moles of acrylic acid per methylol group, Mylar TM polyterephthalate fabric, Dacron TM polyterephthalate fabric, and glass reinforced polyethylene fabric. The last three-noted fabrics were included in the evaluation as these fabrics have heretofore been suggested for use as ablative materials.

Each of the fabrics were tested for tensile strength, tear strength and flammability using the appropriate Japanese Industrial Standard test methods. The results obtained are reported in the following chart.

| MATERIAL | UNTREATED NOVOLOID FIBER | ACETYLATED NOVOLOID FIBER | ACRYLIC ACID-TREATED NOVOLOID FIBER (This Invention) | MYLAR[1] FIBER | DACRON[2] FIBER | GLASS REINFORCED POLY-ETHYLENE | TEST METHOD EMPLOYED |
|---|---|---|---|---|---|---|---|
| Composition % | 100 | 100 | 100 | 100 | 100 | 70/30 | |
| Fabric Weave | Plain | Plain | Plain | Plain | Plain | Plain | |
| Construction | | | | | | | |
| Yarn Count | 30/2 | 30/2 | 30/2 | 30/2 | 30/2 | — | |
| Weight (g/m$^2$) | 195 | 195 | 195 | 195 | 195 | 195 | |
| Thickness (mm) | 0.45 | 0.45 | 0.45 | 0.45 | 0.45 | 0.45 | |
| Tensile Strength (Kg/25 mm) | | | | | | | |
| Warp | 29 | 23 | 39 | 34 | 32 | 28 | JIS[3] |
| Fill | 16 | 14 | 22 | 17 | 15 | 13 | L1068 |
| Tear Strength (Kg) | | | | | | | |
| Warp | 2.2 | 1.8 | 4.3 | 2.8 | 2.9 | 3.2 | JIS[3] |
| Fill | 1.7 | 1.4 | 2.6 | 1.9 | 1.7 | 1.95 | L1079 |
| Flammability | 0 | 4 | 0 | 0 | 0 | 0 | JIS[3] |
| After Flame (Sec) | | | | | | | L1091 |
| Smolding Time (Sec) | 1.9 | 2.3 | 0 | 1.5 | 1.2 | 2.1 | Vertical |
| Carbonized | 5.4 | 6.9 | 1.1 | 6.3 | 17 | 21.5 | |

-continued

| MATERIAL | UNTREATED NOVOLOID FIBER | ACETYLATED NOVOLOID FIBER | ACRYLIC ACID-TREATED NOVOLOID FIBER (This Invention) | MYLAR[1] FIBER | DACRON[2] FIBER | GLASS REIN-FORCED POLY-ETHYLENE | TEST METHOD EMPLOYED |
|---|---|---|---|---|---|---|---|
| Distance (cm) | | | | | | | |

[1]Trademark of E.I. Dupont DeNemours and Company for polyterephthalate fiber
[2]Trademark of E.I. Dupont DeNemours and Company for polyterephthalate fiber
[3]Japanese Industrial Standard The acrylic acid-treated novoloid fibers and fabrics of this invention have exceptional properties for ablative applications. The acrylic acid-treated novoloid fibers, for example, can be used in the fibrous form in combination with a suitable matrix material to prepare molded ablative shields and the like. The acrylic acid-treated novoloid fabrics, however, are preferably used in ablative applications as the inherent strength of the fabric structure generally is more than sufficient to hold the fibers in position during use. In order to utilize the acrylic acid-treated novoloid fabrics, plies of the fabrics are applied as needed to the surface of a spacecraft utilizing well-known methods including the use of high temperature silicone adhesives.

The acrylic acid-treated novoloid fibers and fabrics of this invention are not limited to use in ablative applications but can be used in a wide variety of products wherein high flame resistance is an essential requirement, such as protective clothing and the like.

What is claimed is:

1. A fibrous composition of matter comprising the reaction product of acrylic acid and a novoloid fiber having methylol groups.

2. The fibrous composition according to claim 1 wherein the novoloid fiber contains about 5–6% by weight of methylol groups.

3. The fibrous composition according to claim 1 wherein said acrylic acid is reacted with the novoloid fiber in the ratio of about 2–4 moles of acrylic acid per methylol group of the novoloid fiber.

4. The fibrous composition according to claim 1 wherein the novoloid fiber contains about 5–6% by weight of methylol groups and is reacted with between 2–4 moles of acrylic acid per methylol group.

5. In an ablative heat shield for a spacecraft the improvement wherein the ablative heat shield is comprised of a fibrous reaction product of acrylic acid and a novoloid fiber having methylol groups.

6. The ablative heat shield according to claim 5 wherein the novoloid fiber contains about 5–6% by weight of methylol groups.

7. The ablative heat shield according to claim 5 wherein said acrylic acid is reacted with the novoloid fiber in a ratio of about 2–4 moles of acrylic acid per methylol group.

8. The ablative heat shield according to claim 5 wherein the fibrous reaction product is formed in a layer and secured to a surface of the spacecraft.

9. The ablative heat shield according to claim 5 wherein the fibrous reaction product is formed into a woven fabric and adhered to the surface of the spacecraft.

* * * * *